US010094051B1

(12) United States Patent
Menon et al.

(10) Patent No.: US 10,094,051 B1
(45) Date of Patent: Oct. 9, 2018

(54) ELECTROSPINNING APPARATUS AND METHOD FOR PRODUCING MULTI-DIMENSIONAL STRUCTURES AND CORE-SHEATH YARNS

(71) Applicants: Deepthy Menon, Kochi (IN); John Joseph, Kochi (IN); Shantikumar Nair, Kochi (IN)

(72) Inventors: Deepthy Menon, Kochi (IN); John Joseph, Kochi (IN); Shantikumar Nair, Kochi (IN)

(73) Assignee: AMRITA VISHWA VIDYAPEETHAM, Kerala (IN)

( * ) Notice: Subject to any disclaimer, the term of this patent is extended or adjusted under 35 U.S.C. 154(b) by 0 days.

(21) Appl. No.: 15/992,525

(22) Filed: May 30, 2018

Related U.S. Application Data

(62) Division of application No. 14/751,069, filed on Jun. 25, 2015, now Pat. No. 9,994,975.

(30) Foreign Application Priority Data

Jun. 27, 2014 (IN) ..... 3131/CHE/2014

(51) Int. Cl.
*D02G 3/00* (2006.01)
*D01D 5/00* (2006.01)

(52) U.S. Cl.
CPC ..... *D02G 3/00* (2013.01); *D01D 5/0076* (2013.01); *D01D 5/0084* (2013.01); *D10B 2331/041* (2013.01); *D10B 2401/12* (2013.01); *D10B 2403/033* (2013.01)

(58) Field of Classification Search
CPC ..... D02G 3/00; D01D 5/0076; D01D 5/0084
See application file for complete search history.

(56) References Cited

U.S. PATENT DOCUMENTS

2014/0284827 A1* 9/2014 Pokorny ..... D01D 5/0076 264/6

* cited by examiner

*Primary Examiner* — Xiao S Zhao
(74) *Attorney, Agent, or Firm* — Convergence Intellectual Property Law P.C.; Jonathan Garfinkel

(57) ABSTRACT

Electrospinning apparatus and method for producing multi-dimensional structures such as one-dimensional continuous yarns, two-dimensional mats and three-dimensional cotton-like fluffy scaffolds is disclosed. Further, electrospinning apparatus and method with single collector geometry for producing multi-dimensional structures and core-sheath yarns are disclosed.

15 Claims, 10 Drawing Sheets

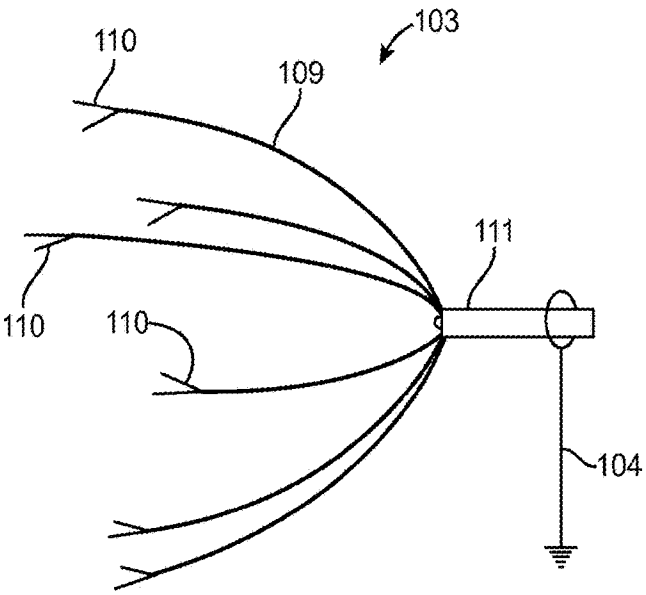
FIG. 2A
FIG. 2B
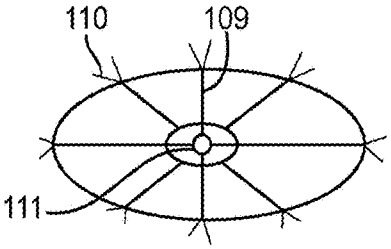
FIG. 2C
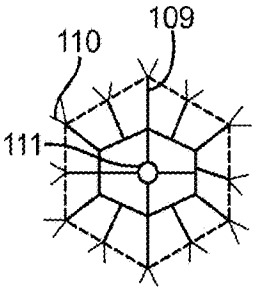
FIG. 2D
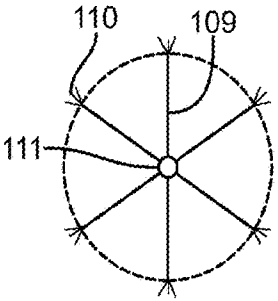
FIG. 2E

ELECTROSPINNING APPARATUS AND METHOD FOR PRODUCING MULTI-DIMENSIONAL STRUCTURES AND CORE-SHEATH YARNS

CROSS-REFERENCES TO RELATED APPLICATIONS

This application is a divisional application of U.S. application Ser. No. 14/750,169 filed on Jun. 25, 2015 titled "ELECTROSPINNING APPARATUS AND METHOD FOR PRODUCING MULTI-DIMENSIONAL STRUCTURES AND CORE-SHEATH YARNS" which claims priority to Indian patent application No. 3131/CHE/2014, filed on 27 Jun. 2014, the full disclosure of which is incorporated herein by reference.

FIELD OF THE INVENTION

The present invention is related to electrospinning apparatus and method for producing multi-dimensional structures such as one-dimensional continuous yarns, two-dimensional mats and three-dimensional cotton-like fluffy scaffolds.

DESCRIPTION OF THE RELATED ART

With foregoing technical advancement, electrospinning technology is widely applied as it is a simple and effective process for producing nano or micro-scale fiber materials. The fiber materials are widely used as biomedical materials, for tissue engineering, as photoelectric materials, filtering materials, sensors and the like. Generally, this technology involves formation of a fine jet of a solution or melt of a polymer or other material in a high-voltage electric field. The jet is ejected from a suitable injector, from which solvent evaporates, leaving behind the fiber as the jet solidifies. Finally, the solidified jet is deposited on a collector unit to form nano- or micro-scale fiber or scaffold.

Traditionally, electrospinning produces flat, highly interconnected scaffolds consisting of densely packed fibers. These electrospun scaffolds support the adhesion, growth, and function of various cell types, and also promote their maturation into specific tissue lineages. However, a major limitation of traditional electrospun scaffolds is that they have tightly packed layers of fibers with a superficially porous network and poor mechanical properties. To improve the porosity and mechanical strength of these scaffolds, means to provide varied geometries is done by altering the fiber deposition pattern during the electrospinning process.

U.S. Pat. No. 8,551,390 discloses an electrospinning apparatus with a plurality of conductive probes to collect the deposited fibers as an uncompressed fiber mesh. US20110039101 discloses a process for preparing electrospun fiber tubular material using multi-dimensional metal rod template for collecting the deposited fibers. WO20130164615 discloses a method for producing an electrospun scaffold by a conductive collector with electrodes arranged in a three-dimensional pattern.

Various mechanical methods such as rotating drums, disks, moving platform collectors, alterations in the external perturbations on spinning jet by manipulations in an electric or magnetic field, gas-assisted electrospinning or variations in collector technique are attempted. However, these known methods yield either non-woven or aligned two dimensional electrospun membranes lacking desirable characteristics such as porosity and strength towards several applications.

In this regard, porous cotton-like fluffy three-dimensional scaffolds as well as one-dimensional continuous yarns possess distinct characteristics as compared to the two dimensional membranes. Although separate techniques are disclosed in the art for generating such varied geometries, it would be highly advantageous and cost-effective to produce varied geometries using a single device or apparatus.

Hence, there exists a high need for producing multi-dimensional structures using single collector geometry for the electrospinning apparatus. Therefore, an electrospinning apparatus and method for producing multi-dimensional structures is developed to eradicate the above mentioned problems.

SUMMARY OF THE INVENTION

A method of producing a two or three-dimensional scaffold by electrospinning is disclosed, comprising loading at least one fiber source at a first potential with solution formulation or melt and placing a rotatable collector unit adjacent the fiber source at a second potential. The collector unit is configured comprising a plurality of electrodes connected at one end and mounted with tines at the other end to form an open structure. Fiber from the source is then deposited into the collector using the potential difference to generate a scaffold. In one aspect of the method the open structure is configured to have diameter in the range 10-20 cm to generate a three-dimensional scaffold. In another aspect the open structure is configured to have diameter in the range 1-10 cm to generate a two-dimensional scaffold. In one aspect of the method, the density of the solution or melt and the diameter of collector are minimized so that a diameter of a whipping region of the fiber exceeds a diameter of the collector to generate a two-dimensional scaffold. In another aspect of the method, the density of the solution or melt and the diameter of the collector are increased such that the whipping region is minimized and the scaffold is contained within the collector to generate a three-dimensional scaffold.

In some aspects, the collector comprises electrodes arranged to form an umbrella-like, hemispherical, semi-cuboidal, semi-cubical, ellipsoidal, cone-like, polygonal or irregular shaped structure, and wherein tines are additionally arranged along the length of the electrodes.

A method of producing one-dimensional yarn by electrospinning is disclosed, comprising, loading a fiber source at a first potential, and placing a rotatable collector unit adjacent to the fiber source at a second potential. The collector unit is configured with a plurality of electrodes connected at one end and mounted with tines at the other end to form an open structure. Fiber from the source is then deposited into the collector unit using the potential difference and spun to one dimensional yarn. The source may comprise an injector loaded with solution formulation or melt and the fiber may be connected through as spinneret. The solution formulation or melt may comprise a drug, growth factor or dye.

A method of producing core-shell yarn by electrospinning is disclosed, comprising loading a plurality of fiber sources at a first potential and placing a rotatable collector unit at a second potential adjacent the fiber sources. The collector unit is configured with a plurality of electrodes connected at one end and mounted with tines at the other end to form an open structure, and fiber from the sources is deposited into the collector using the potential difference. A core yarn is then introduced axially through the collector and the deposited fibers spun over the core yarn to form core-shell yarn. Each fiber source comprises an injector loaded with solution formulation or melt, and each of the fibers is connected through a spinneret. The core yarn may be loaded with a dye or drug. The fiber forming the shell may be loaded with a dye or drug. The core yarn may include fiber formed of a first substance; the shell may include fiber formed for a second substance, each substance incorporating different dye or drug. The mechanical strength of the core yarn or core-shell yarn may be enhanced by twisting the fibers.

This and other aspects are set forth herein.

BRIEF DESCRIPTION OF THE DRAWINGS

The invention has other advantages and features which will be more readily apparent from the following detailed description of the invention and the appended claims, when taken in conjunction with the accompanying drawings, in which:

FIG. 2A to 2E illustrates various embodiments of collector in the electrospinning apparatus.

DETAILED DESCRIPTION OF THE EMBODIMENTS

Figure 1:
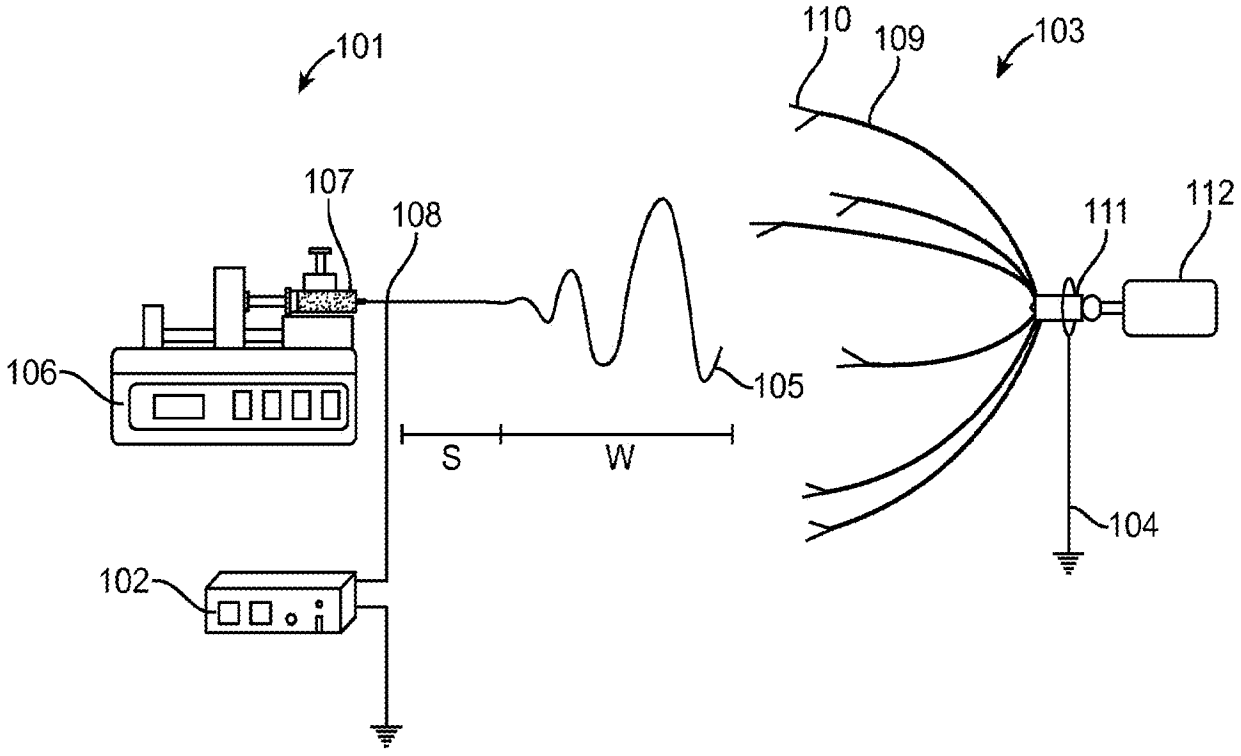
FIG. 1 represents electrospinning apparatus for producing multi-dimensional structures.

While the invention has been disclosed with reference to certain embodiments, it will be understood by those skilled in the art that various changes may be made and equivalents may be substituted without departing from the scope of the invention. In addition, many modifications may be made to adapt to a particular situation or material to the teachings of the invention without departing from its scope.

Throughout the specification and claims, the following terms take the meanings explicitly associated herein unless the context clearly dictates otherwise. The meaning of "a", "an", and "the" include plural references. The meaning of "in" includes "in" and "on." Referring to the drawings, like numbers indicate like parts throughout the views. Additionally, a reference to the singular includes a reference to the plural unless otherwise stated or inconsistent with the disclosure herein.

The proposed invention relating to electrospinning apparatus and method for producing multi-dimensional structures is further described with reference to the sequentially numbered figures.

In one embodiment, an electrospinning apparatus for producing multi-dimensional structures is shown in FIG. 1. The apparatus comprises a fiber source 101 connected to a source of electric potential 102 and a rotatable collector 103 at a second potential 104. In some embodiments the potential source 102 may be maintained at a high positive or negative potential using a suitable high voltage supply. The source 101 comprises an injection system 106 with one or more syringes 107-1, 107-2 etc. (henceforth referred to as syringes 107) loaded with formulated solution or melt, through a spinneret 108. The solution is ejected with jet force from the syringes 107 under electric potential as stable jet region S, which changes into a wavy whipping region W after losing its momentum to solidify into fiber 105. The source 101 is configured to draw a fiber 105 through spinneret 108 and alter its orientation with respect to the axis of rotation of the collector 103.

In one embodiment the collector 103 comprises a plurality of electrodes 109 forming an open basket-like structure. Electrodes 109 are connected at one end to the collector shaft 111 and are mounted with tines 110 at the other end of the collector shaft 111. In various embodiments collector shaft 111 is connected to a rotating motor 112 and may be either grounded or connected to a positive or negative power supply at second potential 104. The difference in potential between the source 101 and collector 103 is used to draw fiber 105 through spinneret 108, which is deposited towards the collector 103.

In various embodiments, the collector 103 in the electrospinning apparatus is envisaged to have variable geometric configuration as shown in FIG. 2A to 2E. The collector 103 comprises electrodes 109 that may be arranged to form an umbrella-like or basket-like structure as shown in FIG. 2A. Alternatively, hemispherical, semi-cuboidal (FIG. 2B), semi-cubical, ellipsoidal (FIG. 2C), polygonal (FIG. 2D), cone-like (FIG. 2E), or irregular shaped structures can be envisaged for collector 103. As shown in FIG. 2A through 2E, in one embodiment the electrodes 109 are provided with tines 110 at the ends, and also at intervals along the length thereof. In some embodiments the electrodes 109 are configured to be flexible and the arrangement of electrodes 109 is adjustable to configure the collector 103 to various shapes and sizes, as may be required for various purposes.

Figure 3A:
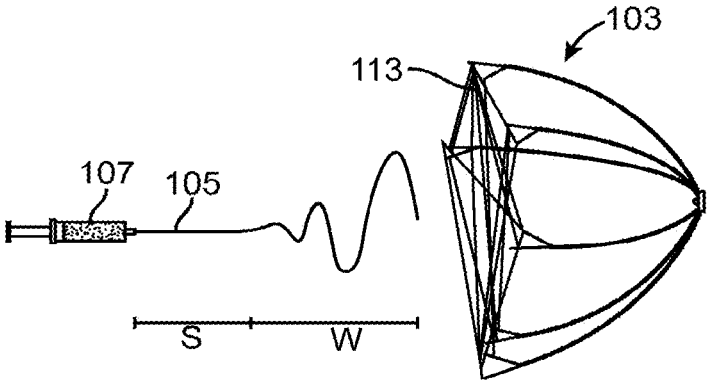
FIGS. 3A, 3B and 3C show electrospinning apparatus and method for producing two and three-dimensional scaffolds.
Figure 3B:
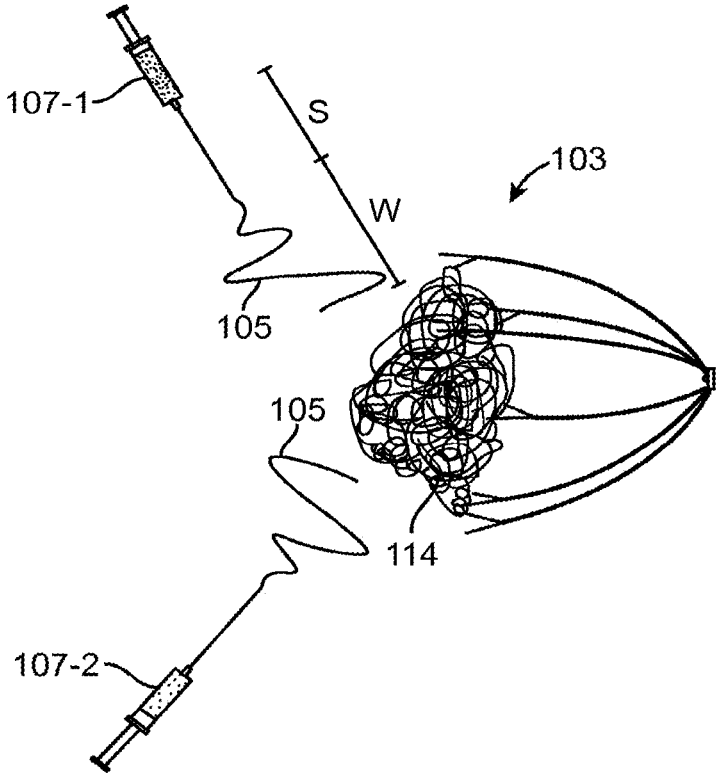
Figure 3C:
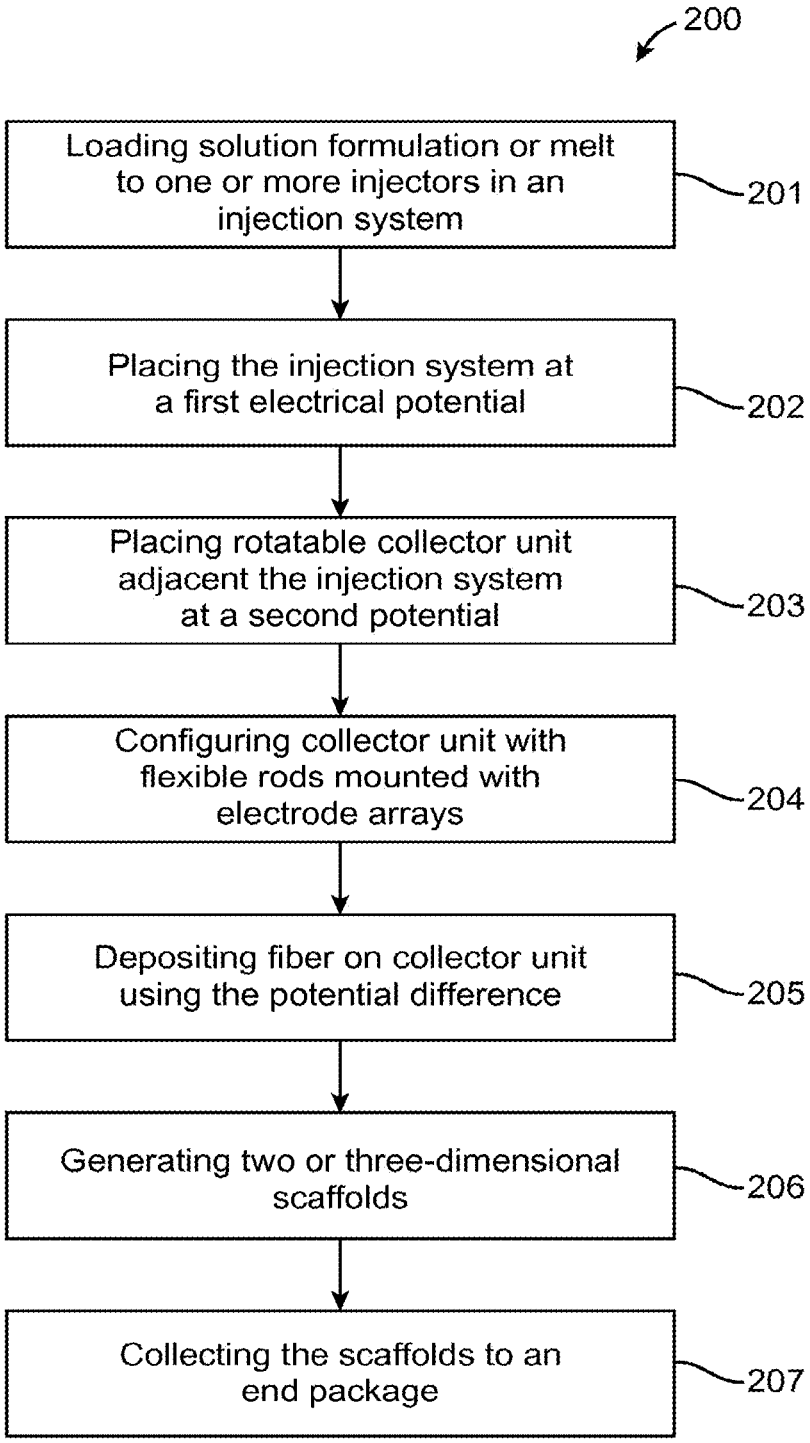

In various embodiments, an electrospinning apparatus configured for producing two- and three-dimensional scaffolds as shown in FIGS. 3A, 3B and 3C. As shown in FIG. 3A, injector 107 is configured to align parallel to the axis of the collector 103 for fabricating two-dimensional scaffolds 113. In one embodiment, the collector 103 is configured to have a diameter in the range 1-10 cm for producing two-dimensional scaffolds.

In one embodiment, as shown in FIG. 3B three-dimensional scaffold 114 is produced with a collector 103 diameter adjusted in the range 10-30 cm. As shown in FIG. 3B, multiple injectors 107-1, 107-2 etc. are introduced at an angle to the collector and may be used to obtain scaffolds of the desired characteristics. In one embodiment, injector 107-1 is configured to inject a first polymer while injector 107-2 is configured to inject a second polymer and so on, to inject a mixture of multiple fibers to the collector. In one embodiment, injectors 107 are configured to inject the same polymer.

In one embodiment, a method of producing two or three-dimensional scaffolds by electrospinning is shown in FIG. 3C. In step 201, solution or melt is formulated and loaded onto an injection system to form a fiber source at a first potential. A rotatable collector unit is placed adjacent to the injection system at a second potential in step 202. The collector unit comprising a plurality of electrodes connected at one end and mounted with electrode arrays at the other end is configured to the desired shape and size in step 203. In one embodiment a two-dimensional scaffold is generated by varying the diameter of the collector unit in the range 1-10 cm in step 203. In step 204, the fiber is deposited from the source into the collector unit using the potential difference between the source and the collector. Finally, the two- or three-dimensional scaffold is collected to an end package in step 206.

In some embodiments of the method described with reference to FIG. 3C, for producing two-dimensional scaffolds, the density of the solution or melt (in step 201) and the diameter of the collector 103 (in step 203) are adjusted such that the whipping region W is maximized. In some embodiments the density of the solution or melt and the diameter of collector 103 are minimized so that the whipping region W takes over the stable region S. In one embodiment, the whipping region W covers a larger area than the diameter of the collector 103 to deposit fibers in the form of a mat or two-dimensional scaffold 113. In some embodiments of the method, for producing three-dimensional scaffolds, the density of the solution or melt and the diameter of the collector 103 are increased such that the whipping region W is minimized and the scaffold is contained within the collector 103.

Figure 4A:
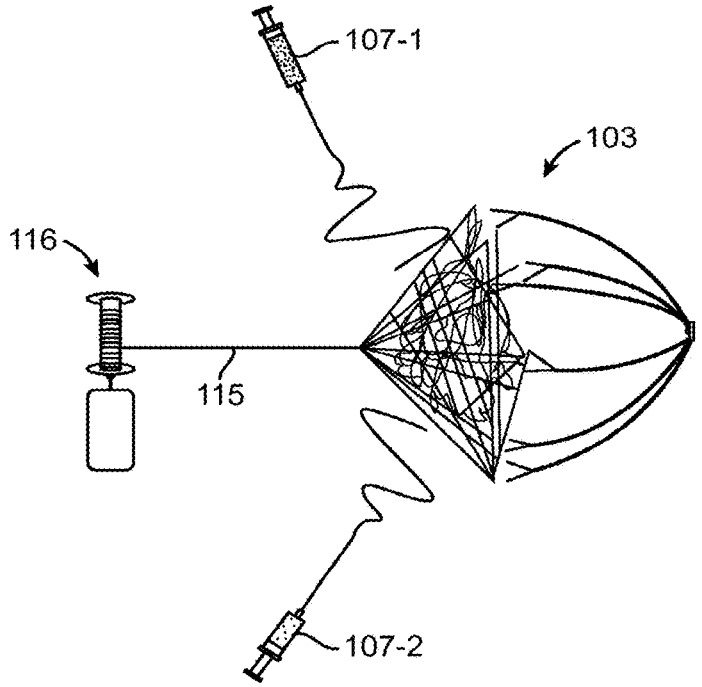
FIGS. 4A and 4B show electrospinning apparatus for producing one-dimensional and core-shell yarns respectively.
Figure 4B:
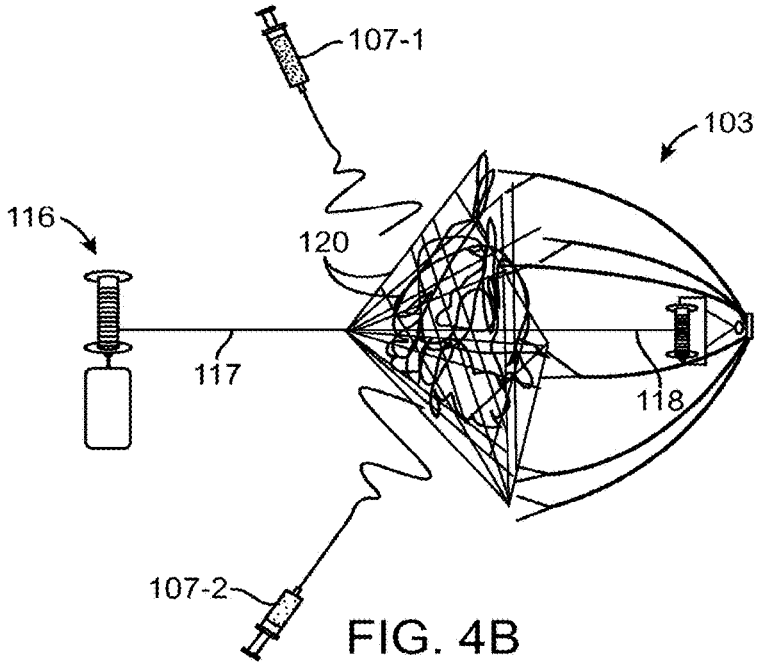
Figure 4C:
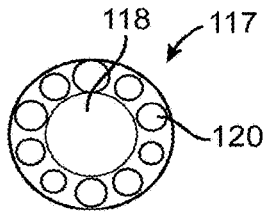
FIG. 4C is a schematic cross section of core-shell yarn.
Figure 5:
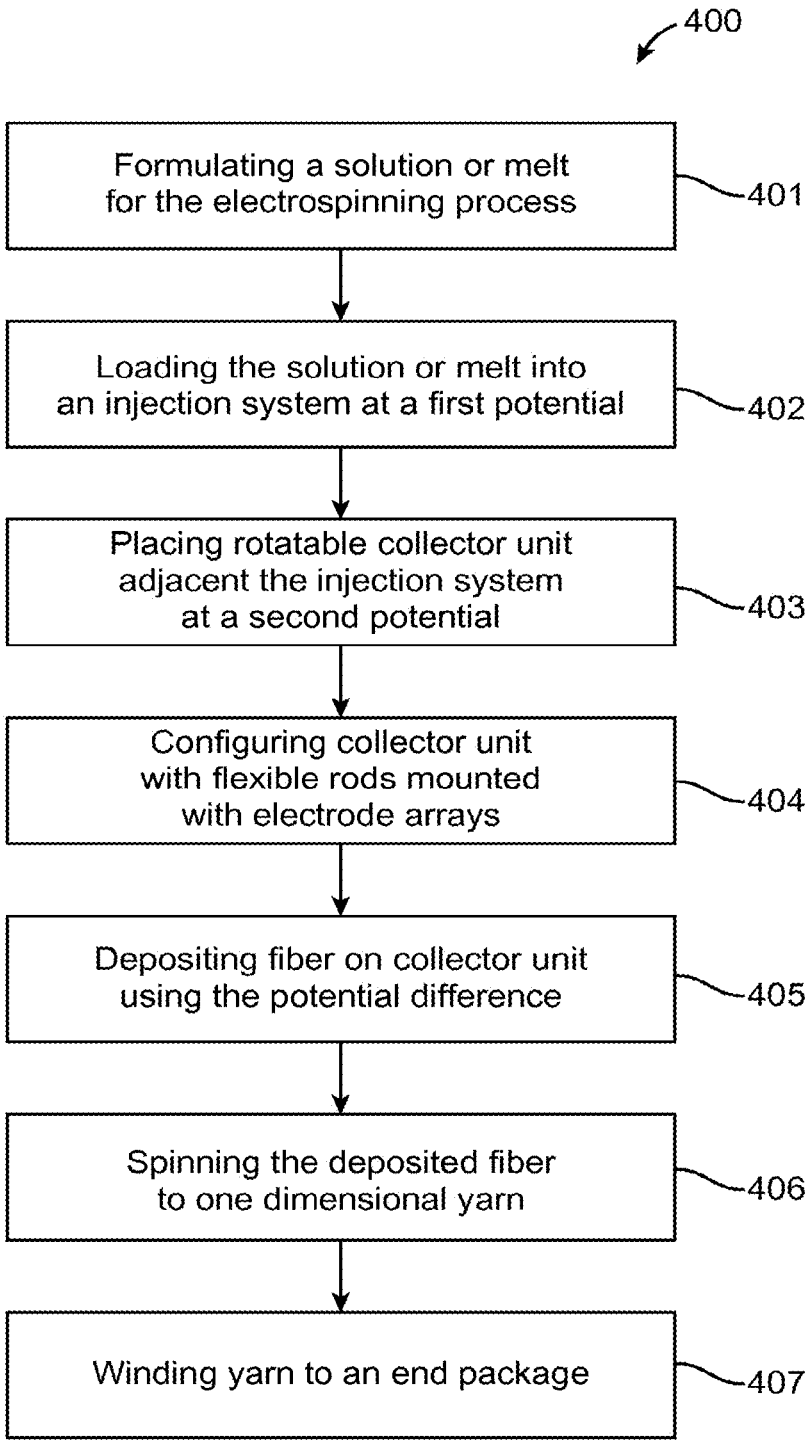
FIG. 5 illustrates method for electrospinning one-dimensional yarns.

In one embodiment, the electrospinning apparatus for producing one-dimensional yarns 115 and core-shell or core-sheath yarns 117 is shown in FIGS. 4A and 4B. The apparatus comprises injectors 107 for introducing one or more fibers to the collector 103, which is drawn to rotating spindle 116 with a guide wire adjacent to the collector 103. The rotatable spindle 116 is configured to draw and impart twist to the deposited fibers to form one-dimensional yarns 115 wound thereon. In one embodiment, a method of producing one-dimensional yarns by electrospinning is shown in FIG. 5. In step 401, solution or melt is formulated and loaded into an injection system to form a fiber source at a first potential. A rotatable collector unit is placed adjacent to the injection system at a second potential in step 402. The collector unit is configured to comprise a plurality of electrodes connected at one end and mounted with electrode arrays at the other end in step 403. In step 404, the fiber is deposited from the source into the collector unit using the potential difference between the source and the collector. The deposited fiber is spun by a rotatable spindle with a guide wire adjacent to the collector to form one dimensional yarn. And finally, the yarn is wound to an end package in step 405.

Figure 6:
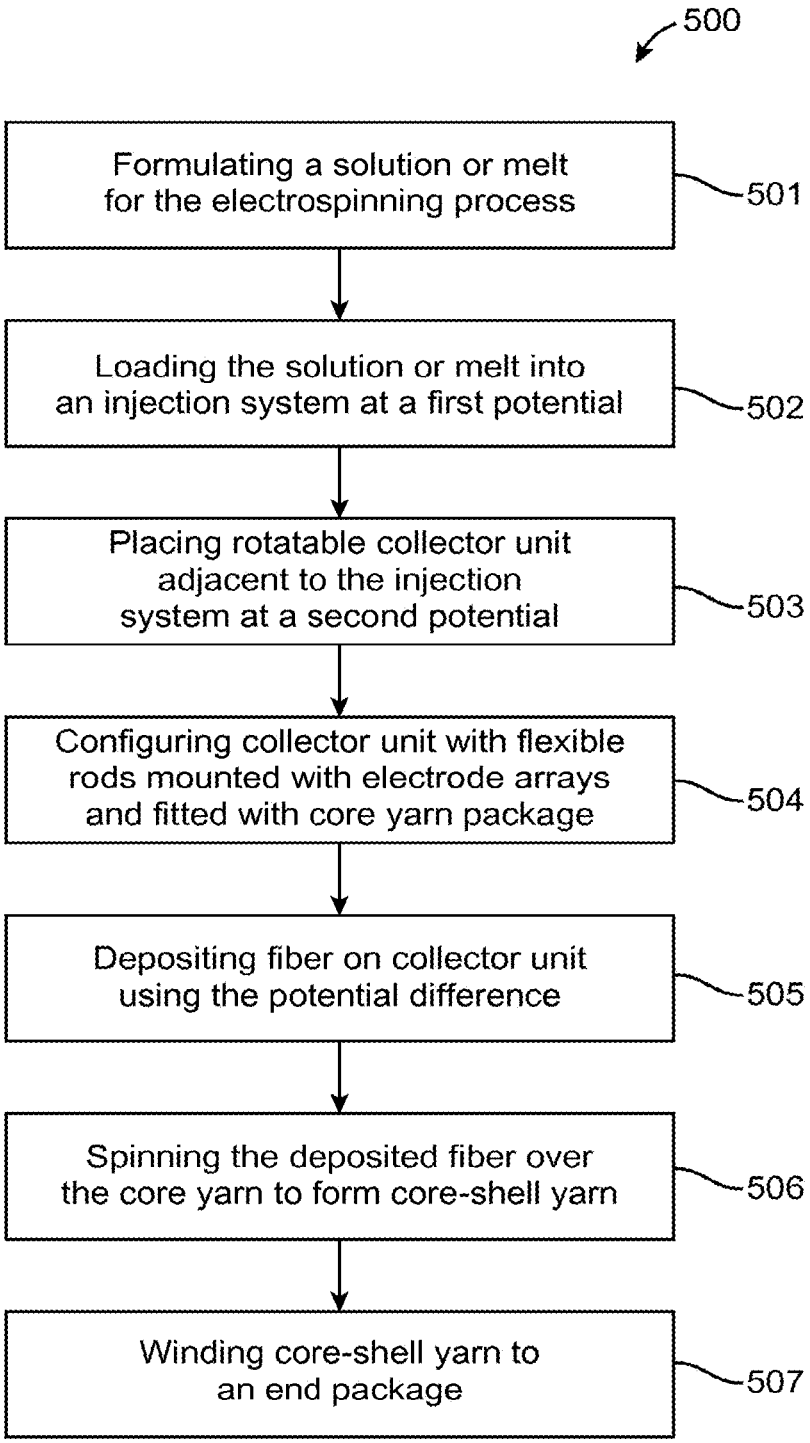
FIG. 6 illustrates method for electrospinning core-shell yarns.

One embodiment of an electrospinning apparatus for producing core-shell yarns 117 is shown in FIG. 4B. The apparatus for producing core-shell yarns 117 comprises a package of core yarn 118 attached to the center of the collector 103. The rotatable spindle 116 is configured to draw both the deposited fiber and core yarn 118 from the collector 103. Further, by rotating the spindle 116, the core yarn 118 is wrapped by the deposited fibers 120 to form core-shell yarn 117. In one embodiment, a method of producing core-shell yarn 117 by electrospinning is shown in FIG. 6. In step 501, solution or melt is formulated and loaded into an injection system to form a fiber source at a first potential. A rotatable collector unit is placed adjacent to the injection system at a second potential in step 502. The collector unit is configured to comprise a plurality of electrodes connected at one end and mounted with electrode arrays at the other end in step 503. In step 504, the fiber is deposited from the source into the collector unit using the potential difference between the source and the collector. A core yarn is introduced axially through the collector towards the spinning unit in step 505. In step 506, the deposited fiber is spun by a rotatable spindle with a guide wire adjacent to the collector, over the core yarn to form core-shell yarn. And finally, the yarn is wound to an end package.

The invention is further illustrated with reference to the following examples, which however, are not to be construed to limit the scope of the invention, as delineated in the appended claims.

EXAMPLES

Example 1

Figure 7A:
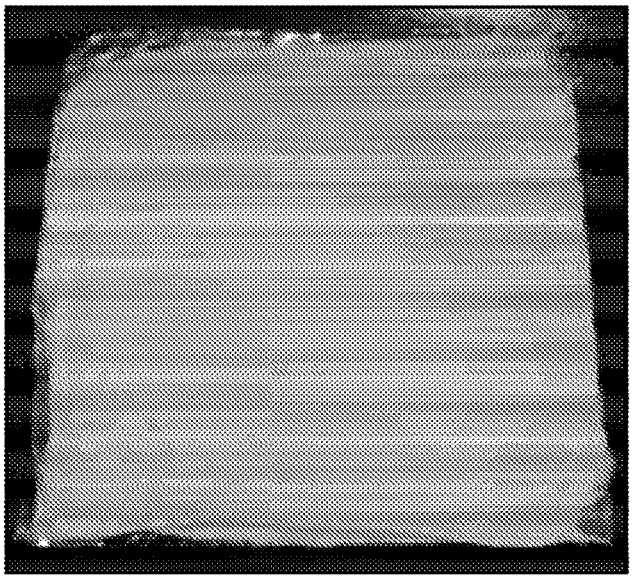
FIG. 7A shows a low magnification optical image of an electrospun mat.
Figure 7B:
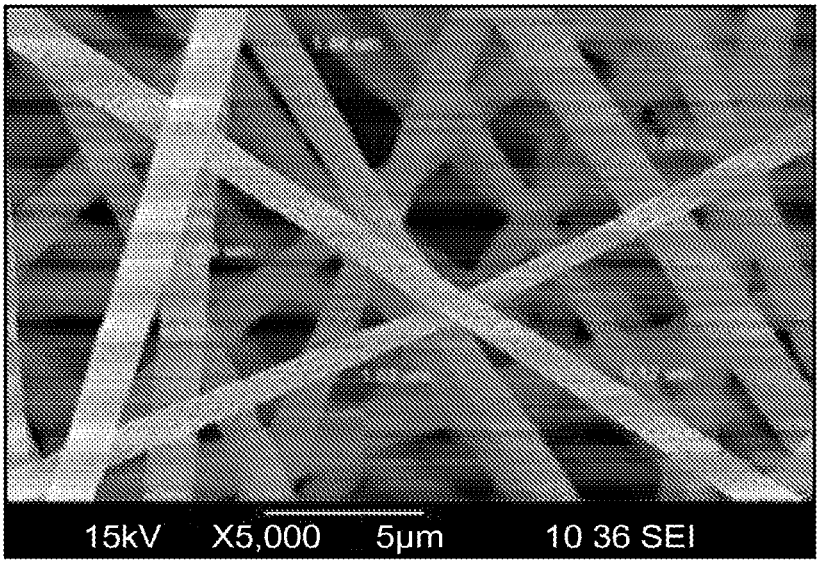
FIG. 7B shows a SEM image of fibers in an electrospun mat.

Example 1 illustrates fabrication of two dimensional non-woven mats using the above electrospinning setup. The polymeric solution was loaded in a syringe connected to a metallic spinneret which was placed at 180° relative to the axis of the collector. The spinneret was maintained at a positive potential (7-15 kV) and the collector was grounded. The rotation speed of the motor attached to the collector was set to 100 rpm so as to maintain a uniform electric field at each circumferential plane of the collector. To obtain 2-D electrospun mats as shown in FIGS. 7A and 7B, the diameter of the collector was adjusted to be less than 10 cm. If mass of polymeric solution (inertia) is low or if the diameter of collector is less than 10 cm, the whipping region takes over the stable region and if the whipping region covers a larger area than the diameter of the collector, fibers will deposit in the form of a mat as shown in FIG. 7A. Other operational parameters such as flow rate, voltage, tip-target distance and concentration of the polymeric solution were optimized by changing the parameters independently such as to generate scaffolds with fibers of optimal diameter.

Example 2

Example 2 illustrates fabrication of three dimensional fluffy scaffolds using the above electrospinning setup. Two syringes loaded with polymeric solution were applied positive and negative polarity (7-15 kV) respectively, and aligned such that their spinnerets were set at ~90° relative to each other and at 45° to the axis of the collector as shown in FIG. 3B. The collector was grounded and the rotation speed of the motor attached to the collector was set to 100 rpm so as to maintain a uniform electric field at each circumferential plane of the collector.

Figure 8A:
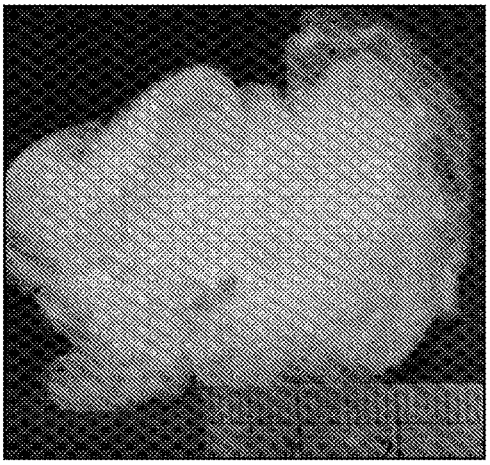
FIG. 8A shows three dimensional electrospun fluffy PLLA scaffolds.
Figure 8B:
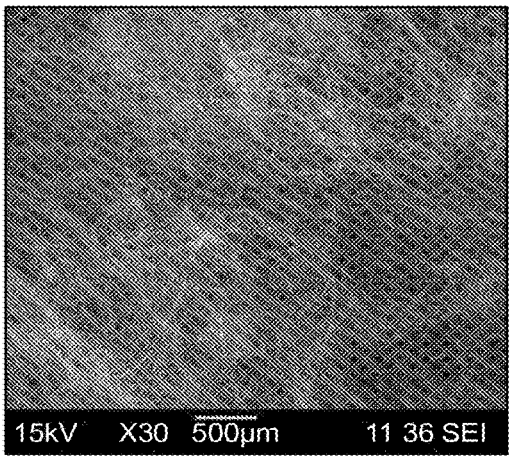
FIGS. 8B, 8C and 8D are SEM images of the same at different magnifications with fiber diameters ranging from 0.74-2 μm.
Figure 8C:
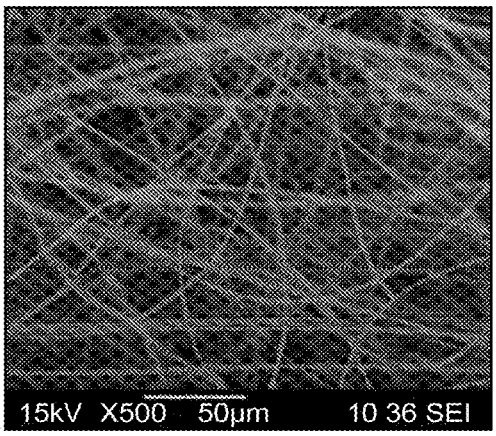
Figure 8D:
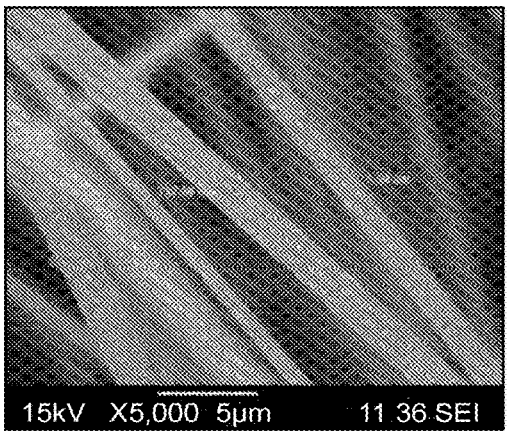

To obtain 3-D fluffy fibers, the diameter of the hemispherical collector was adjusted from 12 to 15 cm. Other operational parameters such as flow rate, voltage, tip-target distance and concentration of the polymeric solution were optimized by changing the parameters independently so as to generate fibrous scaffolds with fibers of optimal diameter. FIG. 8A shows the optical image of three dimensional electrospun fluffy PLLA scaffolds. FIGS. 8B, 8C and 8D are SEM images of the same at different magnifications showing fiber diameters ranging from 0.74-2 μm.

Example 3

In Example 3, using the same electrospinning setup, 1-D continuous yarns were obtained from the 3-D fluffy scaffold deposited within the collector set to a diameter of 12-15 cm. The spinneret in this case was positioned at an angle of 45° with respect to the axis of the hemispherical collector. Such an arrangement would facilitate yarn withdrawal from the collector. After subsequent deposition of fibers onto the needles, a guide wire was introduced to withdraw the fibrous mass, resulting in the formation of a cone near the mouth of the collector. Additionally, the rotation of the collector imparts a twist to the fibers, which in turn bundles them together to form a stable interlocked yarn. These yarns were then drawn towards a rotating mandrel whose speed was synchronized with that of the rotating collector. The variation of individual fiber as well as yarn diameters with parameters such as voltage, concentration of the polymeric solution, flow rate, collector rotation and uptake rate were measured by changing these parameters individually.

The primary yarning parameters included uptake rate, voltage, collector rotation, polymer concentration and flow rate. Yarning was carried out with a typical biocompatible, biodegradable polymer, viz., PLLA. A polymer concentration of 12-13 wt % PLLA was found ideal for this process, yielding continuous yarns of tens of meters in length, having microfibrous architecture.

Mechanical testing of the yarns for measuring the ultimate tensile stress and elongation at break at a maximum load of 0.01N was carried out in triplicates on samples with a minimum length of 4 cm. Maximum tensile strength of PLLA was found to be 35.06±3.5 MPa with 246.5+12.7% elongation at break.

Example 4

Figure 9A:
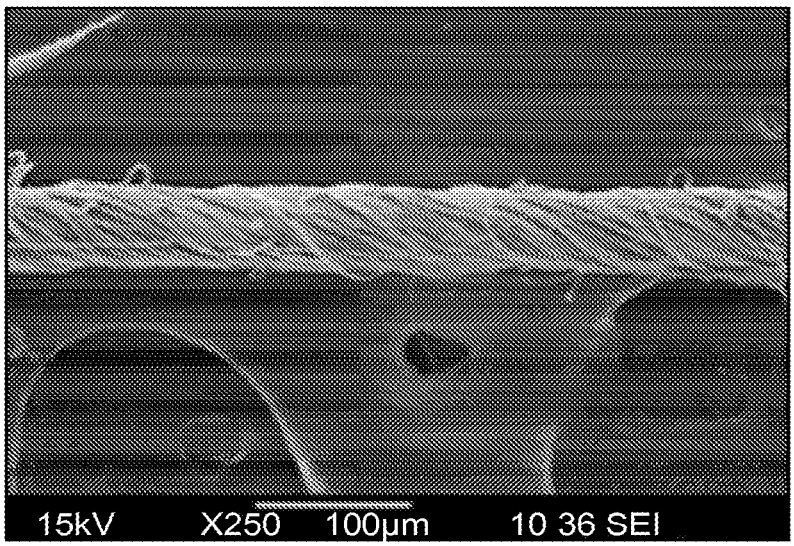
FIG. 9A, 9B show SEM images of multiscale yarns fabricated by co-spinning of PCL and PLLA with fiber diameters ranging from 150 to 800 nm.
Figure 9B:
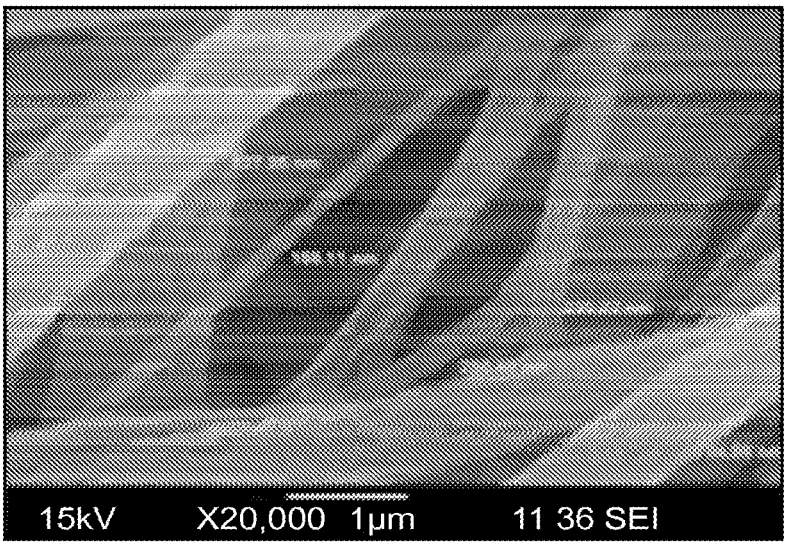

In Example 4, co-spinning of PCL and PLLA were carried out in order to obtain composite nano-micro fibrous yarns. To facilitate the withdrawal of these deposited fibers, the spinnerets were positioned at an angle of 45° with respect to the axis of the collector. One of the spinnerets was maintained at a positive potential (+10 kV) while the other at negative potential (−14 kV). A flow rate of 2.5 ml/h and concentration of 14% w/v for PLLA and PCL were used respectively to obtain micro as well as nanofibers. After subsequent deposition of fibers on the needles, a guide wire was introduced to withdraw the fibrous mass, resulting in the formation of a cone near the mouth of the collector. Additionally, the rotation of the collector imparts a twist to the fibers, which in turn bundles them together to form a stable interlocked yarn structure as shown in FIGS. 9A and 9B.

Mechanical testing of PLLA-PCL composite yarns were carried out in triplicates using an electro-mechanical tensile tester. Each sample with a minimum length of 4 cm was used for testing the ultimate tensile stress and elongation at break at a maximum load of 0.01N. Maximum tensile strength of PLLA-PCL yarns was found to be 23.58±4.53 MPa (Avg±SE) with 289.33±21.83% elongation at break.

The feasibility of using the yarns for biological application was assessed through cell viability tests using human Mesenchymal Stem Cells (hMSCs). Cell viability studies done using Alamar blue assay for a period of 24 h on all three types of scaffold, viz., 1, 2 and 3-D samples, showed a cell viability of 96.30±2.20%, 78.85±2.70% and 89.02±18.41% respectively indicating the biocompatibility of the scaffolds.

Example 5

Using the same electrospinning setup, 1-D continuous PCL nanofibrous yarns were obtained from fibers deposited within the collector set to a diameter of 12-15 cm. To facilitate the withdrawal of these deposited fibers, the spinnerets were positioned at an angle of 45° with respect to the axis of the collector. One of the spinnerets were maintained at positive potential (+12 kV), while the other at a negative potential (−12 kV). A flow rate of 2.5 ml/h and a concentration of 14% w/v yielded PCL nanofibers with fiber diameters ranging from 200 to 600 nm as shown in FIG. 9. After subsequent deposition of fibers onto the needles, a guide wire was introduced to withdraw the fibrous mass, resulting in the formation of a cone near the mouth of the collector. Additionally, the rotation of the collector imparts a twist to the fibers, which in turn bundles them together to form a stable interlocked yarn structure whose yarn diameter was in the range of 50 to 400 μm. These yarns were then drawn towards a rotating mandrel whose speed was synchronized with that of the rotating collector as in the previous examples.

Example 6

In Example 6, using the same electrospinning setup, 1-D continuous microfibrous PU yarns were obtained from fibers deposited within the collector set to a diameter of 12-15 cm. To facilitate the withdrawal of these deposited fibers, the spinneret was positioned at an angle of 45° with respect to the axis of the hemispherical collector. A flow rate of 3 ml/h and a polymer concentration of 14% w/v resulted in microfibrous yarns of polyurethane with diameter of 3.82±0.47 μm at an applied potential of 11 kV. After subsequent deposition of fibers onto the needles, a guide wire was introduced to withdraw the fibrous mass, resulting in the formation of a cone near the mouth of the collector. Additionally, the rotation of the collector imparts a twist to the fibers, which in turn bundles them together to form a stable interlocked yarn structures having diameter 181±23.54 μm. These yarns were then drawn towards a rotating mandrel whose speed was synchronized with that of the rotating collector.

Example 7

In Example 7, using the same electrospinning collector, core-shell yarns were fabricated by placing a spool of yarn in the center of collector, along with subsequent deposition of fibers on to the drawn core yarns as shown in FIG. 4B. Using the same/different polymeric solution, fibers that were deposited as a fluffy mass within the collector of diameter ~8 cm, were drawn together with the core yarn yielding a specific core-shell geometry. The rotation of the collector imparted twist to the shell fibers as well, which in turn bundled them together to form a stable coating over the core yarns. These core-shell yarns were collected on a rotating mandrel whose speed was synchronized with that of the rotating collector. Thickness of the shell layer on the core was adjusted by varying parameters such as flow rate and uptake rate. A decrease in shell thickness was observed upon increasing the yarn uptake rate, while the reverse occurred on enhancing the flow rate. Using the above setup, any combinations of polymers that can be electrospun can be used to develop a core-shell yarn.

In this embodiment, the core yarns were made from 12-13 wt % PLLA, which yielded continuous yarns of 10's of meters in length and diameter typically 150-250 μm having microfibrous architecture. The shell was fabricated using 12 wt % of PLGA, resulting in a total diameter of 180-300 μm for the core-shell yarn. To confirm the deposition of shell over PLLA core, a near infrared dye, viz., Indocyanin Green (ICG) was mixed in the PLGA phase and electrospun on to the PLLA core. The fluorescence images confirmed the incorporation of the dye within the shell, which was absent for the bare core. SEM images further affirmed the formation of a uniform fibrous PLGA shell of typical thickness ~25-40 μm around the PLLA core.

To confirm that the loading of drug/growth factor/dye within the fibrous shell did not affect the mechanical properties of the construct, an evaluation of the force of the core/shell yarn was made in comparison to the core and bare core-shell yarn. Dye loading did not alter the force at break of the core-shell fibrous system, implying its utility for several applications demanding high mechanical strength.

While the above is a complete description of the preferred embodiments of the invention, various alternatives, modifications, and equivalents may be used. Therefore, the above description and the examples should not be taken as limiting the scope of the invention which is defined by the appended claims.

What is claimed is:

1. A method of producing a two or three-dimensional scaffold by electrospinning, comprising:

a. loading at least one fiber source at a first potential with solution formulation or melt;

b. placing a rotatable collector unit adjacent to the fiber source at a second potential;

c. configuring the collector unit comprising a plurality of electrodes connected at one end and mounted with tines at the other end to form an open structure; and d. depositing fiber from the source into the collector unit using the potential difference to generate a scaffold.

2. The method of claim 1, wherein the open structure is configured to have diameter in the range 1-10 cm to generate a two-dimensional scaffold.

3. The method of claim 1, wherein the open structure is configured to have diameter in the range 10-20 cm to generate a three-dimensional scaffold.

4. The method of claim 1, wherein the density of the solution or melt and the diameter of collector are minimized so that a diameter of a whipping region of the fiber exceeds the diameter of the collector to generate a two-dimensional scaffold.

5. The method of claim 1, wherein the density of the solution or melt and the diameter of the collector are increased such that the whipping region is minimized and the scaffold is contained within the collector to generate a three-dimensional scaffold.

6. The method of claim 1, wherein the collector comprises electrodes arranged to form an umbrella, hemispherical, semi-cuboidal, semi-cubical, ellipsoidal, cone, polygonal or irregular shaped structure and wherein tines are additionally arranged along the length of the electrodes.

7. A method of producing yarn by electrospinning, comprising:

a. loading a fiber source at a first potential;

b. placing a rotatable collector unit adjacent to the fiber source at a second potential;

c. configuring the collector unit with a plurality of electrodes connected at one end and mounted with tines at the other end to form an open structure;

d. depositing fiber from the source into the collector unit using the potential difference; and, e. spinning the deposited fiber to yarn.

8. The method of claim 7, wherein the source comprises an injector loaded with solution formulation or melt, and the fiber is deposited through a spinneret.

9. The method of claim 8, wherein the solution formulation or melt comprises a drug, growth factor or dye.

10. A method of producing core-shell yarns by electrospinning, comprising:

a. loading a plurality of fiber sources at a first potential;

b. placing a rotatable collector unit at a second potential adjacent to the fiber sources;

c. configuring the collector unit with a plurality of electrodes connected at one end and mounted with tines at the other end to form an open structure;

d. depositing fiber from the sources into the collector unit using the potential difference;

e. introducing a core yarn axially through the collector; and f. spinning the deposited fiber over the core yarn to form core-shell yarn.

11. The method of claim 10, wherein the each fiber source comprises an injector loaded with solution formulation or melt, and each of the fibers is deposited through a spinneret.

12. The method of claim 10, wherein the core yarn is loaded with a dye or drug.

13. The method of claim 10, wherein the fiber forming the shell is loaded with a dye or drug.

14. The method of claim 10, wherein the core yarn comprises fiber formed of a first substance and the shell comprises fiber of second substance, the first and second substance incorporating different drug or dye.

15. The method of claim 10, wherein the mechanical strength of core yarn or core-shell yarn is enhanced by twisting the fibers.

* * * * *